US005590463A

United States Patent [19]

Feldman et al.

[11] Patent Number: 5,590,463

[45] Date of Patent: Jan. 7, 1997

[54] CIRCUIT BOARD CONNECTORS

[75] Inventors: Steven Feldman; David C. Jenkins, both of Huntingdon, Pa.

[73] Assignee: Elco Corporation, Huntingdon, Pa.

[21] Appl. No.: 503,694

[22] Filed: Jul. 18, 1995

[51] Int. Cl.[6] ..... H01R 43/00

[52] U.S. Cl. ..... 29/844; 439/736; 439/869; 29/883; 29/878

[58] Field of Search ..... 29/842, 844, 876, 29/877, 878, 882, 883; 439/736, 869

[56] References Cited

U.S. PATENT DOCUMENTS

| | | | |
|---|---|---|---|
| 4,083,902 | 4/1978 | Clyde | 264/26 |
| 4,583,807 | 4/1986 | Kaufman et al. | 439/79 |
| 4,976,634 | 12/1990 | Green et al. | 439/736 |
| 5,188,535 | 2/1993 | Bertho et al. | 439/83 |

FOREIGN PATENT DOCUMENTS 3410461 9/1985 Germany .

*Primary Examiner*—P. W. Echols
*Assistant Examiner*—Adrian L. Coley
*Attorney, Agent, or Firm*—Loeb & Loeb LLP

[57] ABSTRACT

A process for fabricating an electrical connector by the steps of: providing a housing of thermoplastic material having a front surface which will constitute an exterior surface of the connector, a rear surface and an opening extending to the rear surface; installing a conductive contact member so that at least a portion of the conductive contact member is positioned in the opening; and heating a portion of the housing adjacent the rear surface while displacing the portion of the housing to a location to extend across the opening and to contact the conductive contact member, and then allowing the portion of the housing to solidify at that location. The electrical connector may initially have a through opening which extends between the front and rear surfaces and the portion of the housing which is heated will be displaced in a manner to close the opening.

15 Claims, 4 Drawing Sheets

Fig. 1
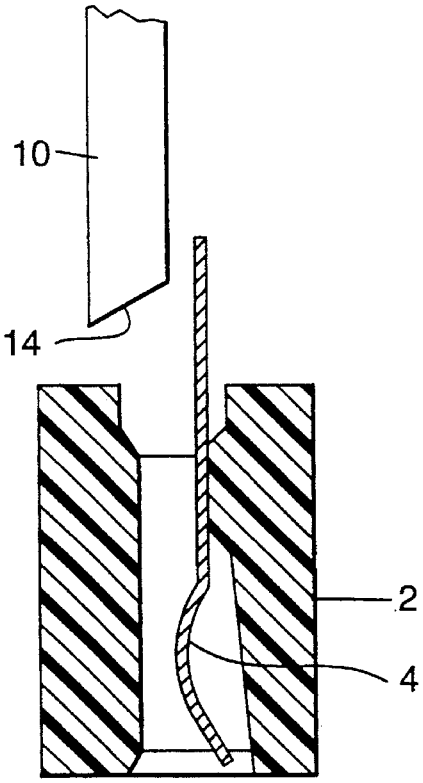
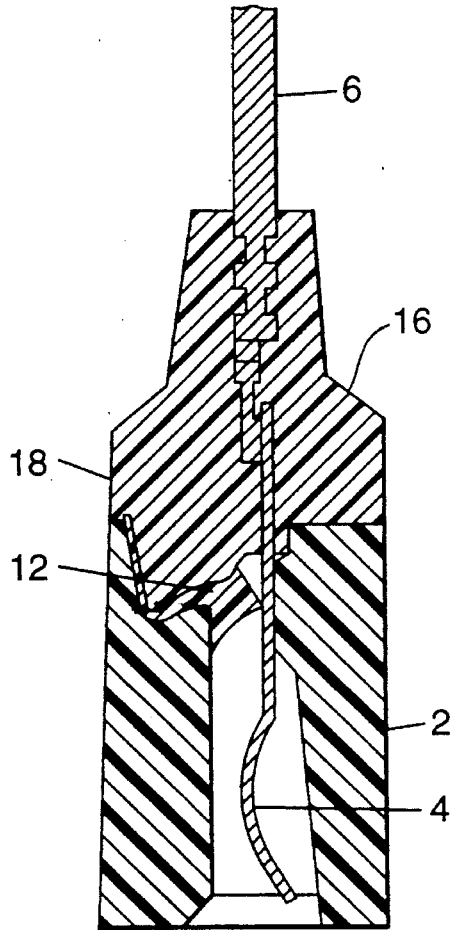
Fig. 3
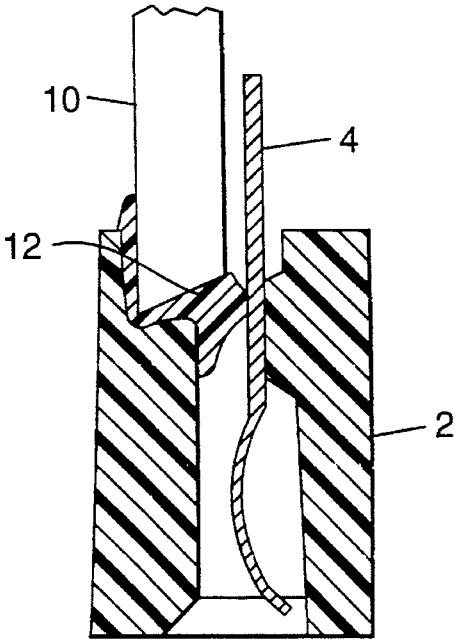
Fig. 2

Fig. 4
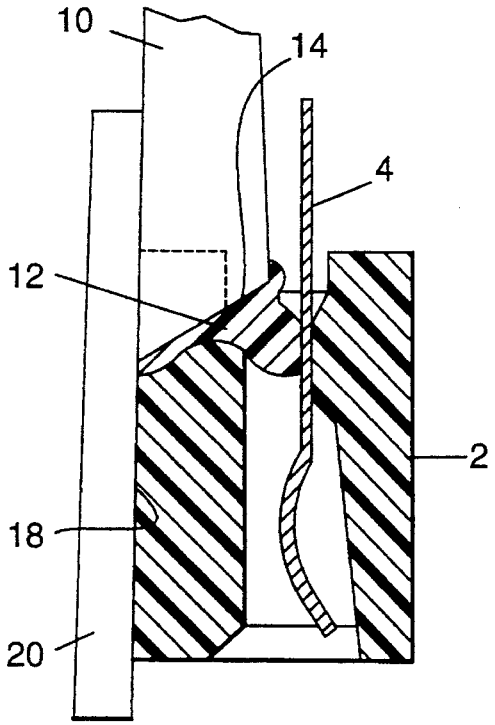
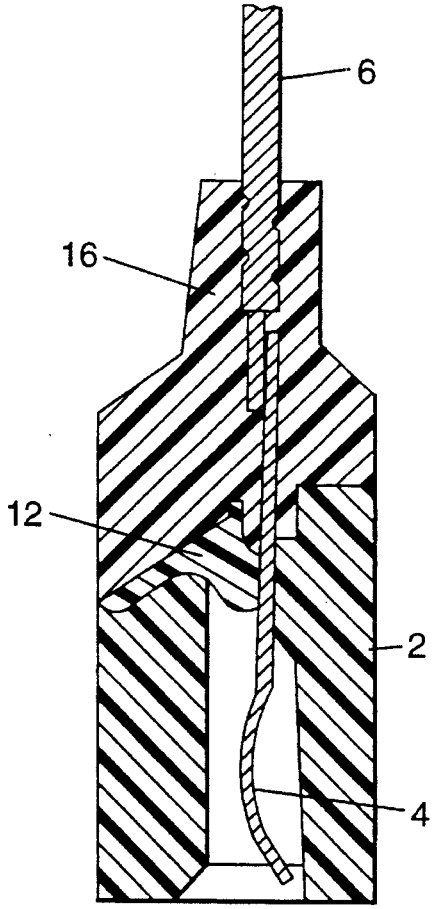
Fig. 5
Fig. 6
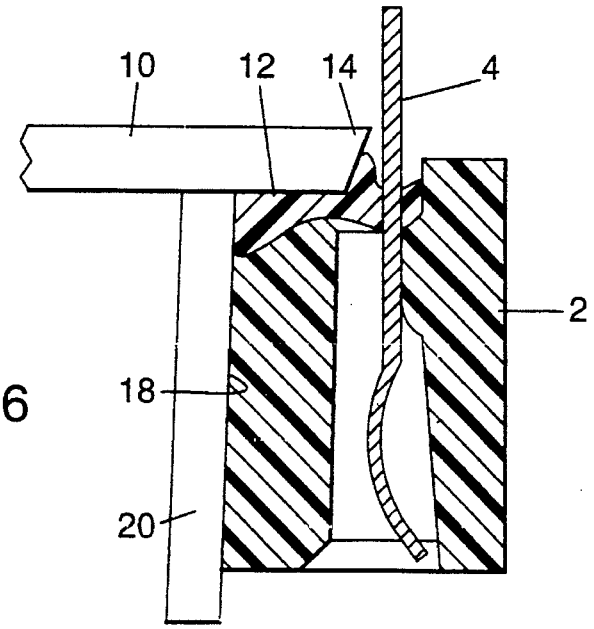

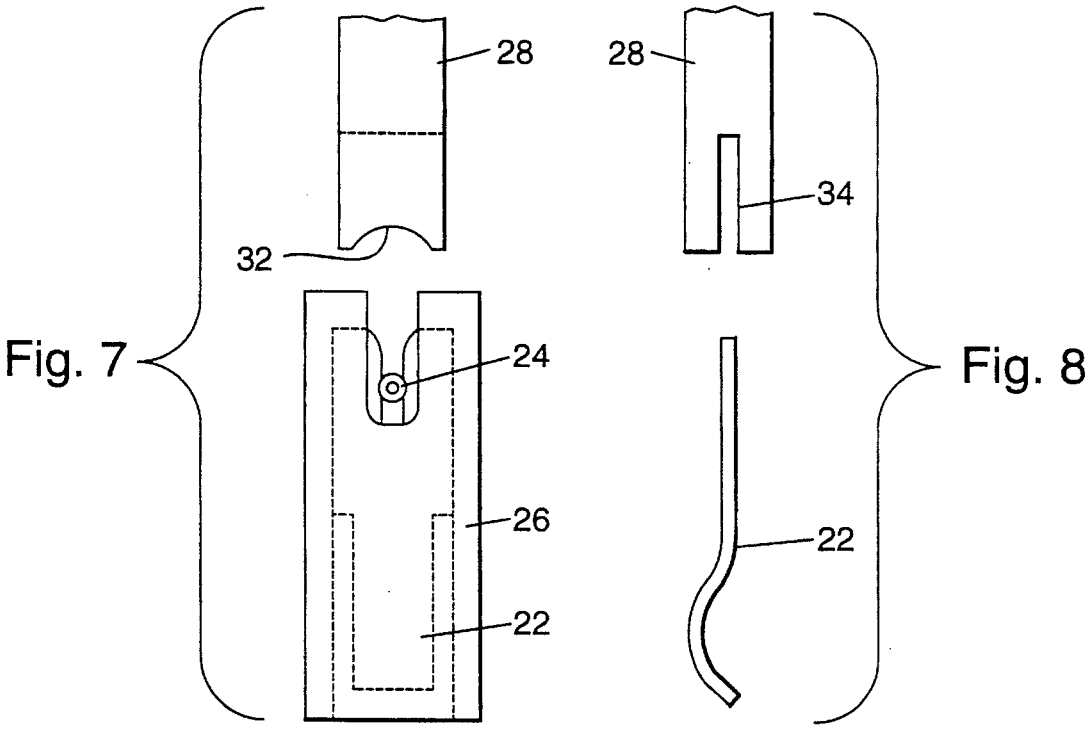
Fig. 7
Fig. 8
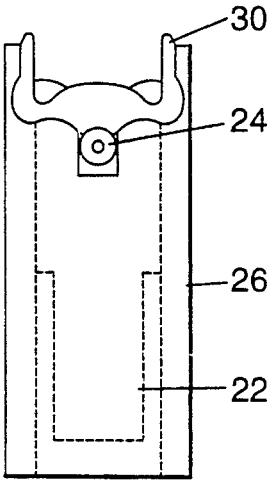
Fig. 9

CIRCUIT BOARD CONNECTORS

BACKGROUND OF THE INVENTION

The present invention relates to connectors for attachment to electronic components such as, for example, circuit boards.

Components for electronic equipment, such as circuit boards, cables, individual wires, etc., are generally provided with connectors, for example a bus connector which composed of a plurality of contacts which are secured in an insulating housing that may be made of a thermoplastic material. Each contact of such a connector is connected to a wire, or tail, via which electrical connection will be made between the contact and a conductor on an associated circuit board.

In the fabrication of such a connector, the rear side of the housing, which faces toward the circuit board, is closed by a further plastic body which is cast or injection molded onto the housing to close each housing opening in which a contact is held and to seal the connecting joint between the contact and its associated connecting lead.

During such casting or injection molding, the plastic material which is being cast or injection molded can intrude into the housing openings containing the contacts. The plastic which enters these openings can adversely affect the spring deflection characteristics of the contacts and/or can prevent proper insertion of a connecting pin of a mating connector and/or can contaminate connecting surfaces of the contacts.

In order to prevent plastic which is being cast or injection molded to such a housing from flowing into the housing openings, it is known to seal those openings, prior to casting or molding of the further plastic body, by applying an epoxy or other sealing material. The step of adding such a sealing material adds to the time and cost of the connector manufacturing process.

It has been proposed to fix electrical contacts in a connector body by melting a portion of the connector body to cause material to flow into a well in which the contact has been positioned in order to secure the contact in place. U.S. Pat. No. 5,046,243 discloses a procedure of this type using ultrasonic heating. This patent additionally mentions that melting of the connector material by direct application of heat is cumbersome and time-consuming. The patent does not give any details of such a melting technique.

SUMMARY OF THE INVENTION

It is an object of the present invention to seal the housing openings in such a connector housing without significantly increasing the connector fabrication time or cost.

A more specific object of the invention is to seal the openings in a connector housing without requiring any separate sealing material or additional handling.

The above and other objects are achieved, according to the invention, by a process for fabricating an electrical connector composed of a housing of thermoplastic material having a front surface which will constitute an exterior surface of the connector, a rear surface, and a through hole extending between the front and rear surfaces; and a conductive contact member having at a portion which is positioned in the through hole such that the through hole is initially at least partially unobstructed between the front and rear surfaces, which process includes heating a portion of the housing to a softened state while applying a displacement force to the housing portion to displace the housing portion to a location to close the through hole, and then allowing the portion to solidify at that location.

BRIEF DESCRIPTION OF THE DRAWING

FIGS. 1, 2 and 3 are cross-sectional views showing successive steps in a first embodiment of the process according to the present invention.

FIGS. 4 and 5 are cross-sectional views showing successive steps in a process according to a second embodiment of the invention.

FIG. 6 is a cross-sectional view illustrating a stage in a process according to a third embodiment of the invention.

FIG. 7 is a side elevational view showing a first step in a process according to a fourth embodiment of the invention.

FIG. 8 is a side elevational view taken in a plane perpendicular to that of FIG. 7 and showing two of the components illustrated in FIG. 7.

FIG. 9 is a side elevational view in the same plane as FIG. 7 showing a further stage in the process according to the fourth embodiment of the invention.

DESCRIPTION OF THE PREFERRED EMBODIMENTS

Figure 10:
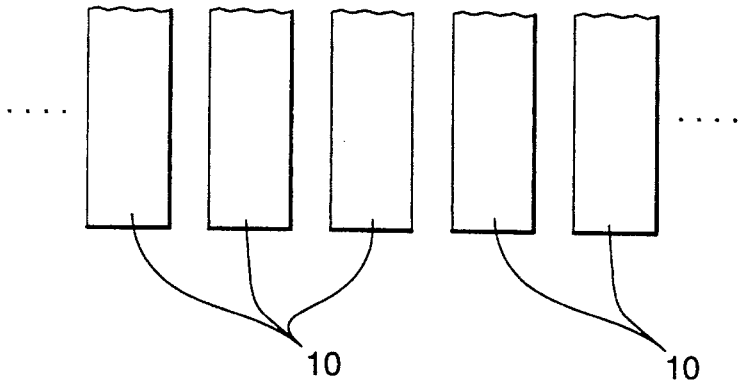
FIG. 10 is a side elevational detailed view showing a heating assembly used in the performance of processes according to the invention.

FIG. 1 is a cross-sectional view showing a connector housing 2 provided with contact openings, or through holes, one of which is seen in the drawing. At the fabrication stage shown in FIG. 1, the contact opening extends completely through housing 2. In the contact opening there is installed and held, in any suitable manner, a contact 4 having, at its lower end, a first portion which will engage with a contact of a mating connector (not shown). Contact 4 has a middle portion which is held in place by any suitable means against a wall of housing 2 and a top portion which will subsequently be connected to a connecting wire 6 (FIG. 3) that can serve as a connecting tail via which contact 4 will be connected to a conductor on a circuit board. Wire 6 can also be a conductor of a cable.

As can be seen in FIG. 1, the contact opening in housing 2 is initially open at its rear end. Housing 2 is a molded part made of thermoplastic material. In a first stage of a process according to the first embodiment of the invention, a heating bar 10 is moved downwardly from the position shown in FIG. 1 to contact the rear end of housing 2 so as to soften a portion 12 of the thermoplastic material of housing 2, as shown in FIG. 2. Heating bar 10 is formed, as being provided with an inclined end surface 14, to displace and preferentially direct thermoplastic material portion 12 which has been softened toward contact 4 in a manner to seal the contact opening in housing 2 at the rear end thereof, which is the upper end in the drawing. After heating bar 10 is withdrawn, portion 12 will resolidify and form a seal for the associated contact opening. This seal will help to prevent contaminants, such as dust or moisture, from entering an enclosure in which the connector may be installed.

Then, as shown in FIG. 3, wire 6 is soldered to the rear end of contact 4 and a further body 16 of insulating material is overmolded onto housing 2 so as to securely hold contact 4 and wire 6. As appears in FIG. 3, wire 6 is provided with indentations that are filled by material of body 16, thereby securing wire 6 to the resulting connector and providing stress relief for the solder joint between 4 and wire 6.

During overmolding of body 16, overmolded material is prevented from flowing into the contact opening in housing 2 by the previously softened portion 12 of housing 2. In addition, during the overmolding operation, a smooth, continuous wall 18 is formed partially by housing 2 and partially by body 16.

A second embodiment of a process according to the invention is illustrated in FIGS. 4 and 5, where components identical to those of FIGS. 1–3 are given the same reference numerals and will not again be described in detail. The second embodiment is preferably employed if softening of the plastic material might cause heat distortion of housing 2 in the vicinity of wall 18, and/or if softened plastic may project beyond wall 18. In this embodiment, before bringing bar 10 into contact with housing 2, a non-heat conductive or cooled plate 20 is clamped against wall 18. A non-heat conductive plate will tend to remain at a temperature below the softening point of the plastic material because it will absorb minimal heat from bar 10. Then heating bar 10 is brought into the position shown in FIG. 4 in order to soften and displace a portion 12 of housing 2. Also shown in broken lines in FIG. 4 is the initial configuration of housing 2 prior to the start of softening by the action of heating bar 10. The material in the broken line portion of housing 2 forms portion 12 after the softening step. After heating bar 10 is withdrawn and portion 12 has resolidified, plate 20 is withdrawn and body 16 is overmolded onto housing 2 to form the finished assembly shown in FIG. 5.

The softening step in a fabrication operation according to a third embodiment of the invention is shown in FIG. 6. In this embodiment, heating bar 10 is moved into its heating and displacing position from the side and cooperates with plate 20 to prevent heat distortion of housing 2 and/or to prevent portion 12, while in a flowable state, from flowing past wall 18.

In a modified form of the process shown in FIG. 6, plate 20 can be eliminated in those situations where softening of portion 12 of housing 2 will not cause thermal distortion of housing 2 in the vicinity of wall 18 and/or flow of softened material of portion 12 beyond the boundary defined by wall 18.

When a connector according to the invention is to form a part of circuit card which contains an encapsulated circuit board, the body 16 shown in FIGS. 3 and 5 can be replaced by the circuit card encapsulating material. In this case, contact tails would be connected between contacts 4 and circuit board bonding pads before the encapsulating material is applied. Here again, the seal formed according to the invention will prevent encapsulating material from flowing into the connector housing through holes and will thus not adversely affect the performance of contacts 4.

A further embodiment of the procedure according to the invention is shown in FIGS. 7, 8 and 9. This procedure is employed when a contact 22, shown essentially in broken lines in FIGS. 7 and 9, is provided with a slot in which an insulated wire 24 is to be gripped in such a manner that portions of contact 22 which border the slot will penetrate the insulation of wire 24 and electrically contact the conductor of wire 24. In the embodiment shown in FIGS. 7–9, the first portion of contact 22 which is to be connected to a mating connector pin, has the same form as that shown in FIGS. 1–6.

Contact 22 is retained in a housing 26 of thermoplastic material and, after wire 24 has been attached to contact 22, a heating bar 28 is moved downwardly against the upper end of housing 26 in order to soften and displace a portion 30 of the plastic constituting housing 26. When the portion 30 subsequently solidifies, after retraction of heating bar 28, it forms a secure connection between contact 22 and wire 24, thereby providing strain relief between, and provides relief between contact 22 and wire 24.

As can be seen in FIG. 7, heating bar 28 is provided, at its leading end, with a recessed portion 32 that will fit around wire 24 during softening of portion 30 and will direct softened plastic around and into contact with wire 24. In addition, as can best be seen in FIG. 8, heating bar 28 is provided with a slot 34 that will straddle contact 22 so as to enable the leading end of bar 28 to be lowered to the desired final position relative to contact 22. In the embodiment illustrated in FIGS. 7–9, contact 22 can be formed to constitute an IDC terminal, or slotted beam.

The embodiment shown in FIGS. 7–9 can be a multicomponent connector, and the contact 22 illustrated in those Figures can be the contact at one end of that connector. A further body of plastic material, similar to body 16, may or may not be overmolded onto housing 26 after completion of the softening process.

In connection with all of the disclosed embodiments of the invention, the contacts employed can have other forms and can be constituted by sockets, pins, spade connectors, etc.

As already noted above, the present invention can be employed to seal a plurality of contact openings in a connector housing. To perform this operation, use is preferably made of a heating assembly which carries a plurality of heating bars 10, as shown in FIG. 10. These heating bars can be displaced in unison to effect sealing of a plurality of contact openings, arranged in a row, simultaneously. This arrangement can be used for the procedures illustrated in FIGS. 1–5 and for the procedure illustrated in FIG. 6.

In all embodiments of the invention, the heating bars 10, 28 are preferably dimensioned and located to remain spaced from their associated contacts 4, 22 during the entirety of the softening and displacement procedure. The reason for this is to prevent heat from being transferred by the contacts to portions of the associated connector housing 2, 26 which hold the associated contact in position. If those portions should become softened during the sealing operation, the contacts may be shifted from their desired positions.

Figure 11:
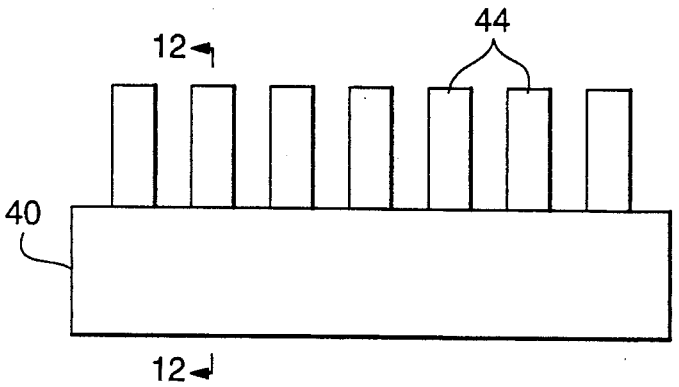
FIG. 11 is a side elevational view illustrating a further device used in processes according to the invention.
Figure 12:
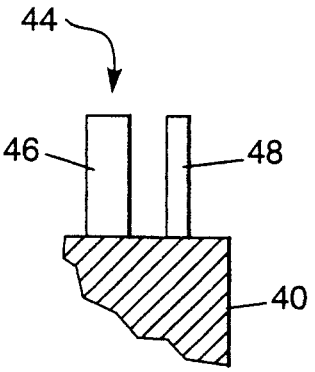
FIG. 12 is a cross-sectional view taken along the line 12—12 of FIG. 11.

To further prevent shifting of contacts 4, 22 during the sealing operation, connector housing 2, 26 can be brought into engagement with a cooling plate, or heat sink 40 as shown in FIGS. 11 and 12. Heat sink 40 is provided with a plurality of projecting elements 44, each of which will be plugged into a respective contact opening of a connector housing via the front end of the housing. As shown in FIG. 12, each projecting element 44 can be made of two parts 46, 48 which will fit around a first portion of a connector 4, 22 in order to both conduct heat away from the connector and hold the connector in place.

In all of the disclosed embodiments of the invention, the connector housing is constructed such that, after softening and displacement of housing portions, the remainder of the connector housing has sufficient structural integrity to securely retain the associated contacts in their desired positions.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A process for fabricating an electrical connector comprising:

providing a housing of thermoplastic material having a front surface which will constitute an exterior surface of the connector, a rear surface and a through hole extending in a direction between the front and rear surfaces;

installing a conductive contact member in the through hole, the conductive contact member having a first portion engageable with a contact of a mating connector and a second portion which is spaced from the first portion and which is held in place in the through hole by the housing so that the through hole is initially at least partially unobstructed between the front and rear surfaces; and heating a portion of the housing to a softened state while applying a displacement force to displace the heated housing portion to a location to close the through hole, and then allowing the portion of the housing to cool and solidify at that location.

2. A process as defined in claim 1 wherein the portion of the housing which is heated during said heating step is adjacent the rear surface of the housing.

3. A process as defined in claim 2 wherein said step of heating is carried out by bringing a heating bar into contact with the housing and transferring heat from the bar to the portion of the housing which is heated.

4. A process as defined in claim 3 wherein the heating bar has a leading end which is shaped to direct the portion of the housing which is heated, when softened, toward the location to close the through hole.

5. A process as defined in claim 4 wherein the said step of bringing the heating bar into contact with the housing hole is carried out by moving the heating bar parallel to the direction in which the through hole extends.

6. A process as defined in claim 4 wherein the said step of bringing the heating bar into contact with the housing hole is carried out by moving the heating bar perpendicular to the direction in which the through hole extends.

7. A process as defined in claim 1 wherein the housing has a side wall which extends between the front and rear surfaces and which is located adjacent the portion of the housing which is heated, said process further comprising preventing material of the portion of the housing which is heated from flowing beyond the side wall when the portion is heated.

8. A process as defined in claim 7 wherein said step of preventing is carried out by placing a plate against the side wall during at least part of said heating step.

9. A process as defined in claim 8 wherein the portion of the housing which is heated during said heating step is adjacent the rear surface of the housing.

10. A process as defined in claim 9 wherein said step of heating is carried out by bringing a heating bar into contact with the housing and transferring heat from the bar to the housing.

11. A process as defined in claim 10 wherein the heating bar has a leading end which is shaped to direct the portion of the housing which is heated, when heated, toward the location to close the through hole.

12. A process as defined in claim 1 wherein the portion of the housing which is heated during said heating step is adjacent the rear surface of the housing, and the contact member has a rear end portion which projects from the rear surface of the housing, and comprising the further step of casting or molding a body of insulating material to the rear surface of the housing and around the rear end portion of the contact member.

13. A process as defined in claim 12 further comprising forming a connection between a connecting lead and the rear end portion of the contact member.

14. A process as defined in claim 13 wherein the body of insulating material encloses the connection between the connecting lead and the rear end portion of the contact member.

15. A process for fabricating an electrical connector comprising:

providing a housing of thermoplastic material having a front surface which will constitute an exterior surface of the connector, a rear surface and an opening extending to the rear surface;

installing a conductive contact member so that at least a portion of the conductive contact member is positioned in the opening for attachment to a connecting lead;

attaching a connecting lead to the contact member portion in the opening; and heating a portion of the housing adjacent the rear surface to a softened state while applying a displacement force to displace the heated housing portion into contact with both the contact member portion and the connecting lead, and then allowing the portion of the housing to cool and solidify at that location.

* * * * *